United States Patent [19]

Brammer

[11] 4,428,332

[45] Jan. 31, 1984

[54] TRANSDUCER FOR IGNITION TIMING

[75] Inventor: Hartmut Brammer, Vaihingen, Fed. Rep. of Germany

[73] Assignee: Robert Bosch GmbH, Stuttgart, Fed. Rep. of Germany

[21] Appl. No.: 311,290

[22] Filed: Oct. 14, 1981

[30] Foreign Application Priority Data

Nov. 3, 1980 [DE] Fed. Rep. of Germany ..... 3041314

[51] Int. Cl.[3] ..... F02P 5/04

[52] U.S. Cl. ..... 123/146.5 A; 123/617; 123/406; 310/70 A; 310/191; 310/209

[58] Field of Search ..... 123/146.5 A, 406, 414, 123/617; 310/70 R, 70 A, 190, 191, 192, 209

[56] References Cited

U.S. PATENT DOCUMENTS

| | | | |
|---|---|---|---|
| 3,198,973 | 8/1965 | Short et al. | 310/209 |
| 3,518,978 | 7/1970 | Schmiedel | 123/146.5 A |
| 4,011,476 | 5/1977 | Beard | 310/70 R |
| 4,275,703 | 6/1981 | Bodig et al. | 310/70 A |

FOREIGN PATENT DOCUMENTS

| | | | |
|---|---|---|---|
| 1087268 | 8/1960 | Fed. Rep. of Germany | 310/191 |
| 2814459 | 10/1978 | Fed. Rep. of Germany | 123/146.5 A |
| 3008072 | 9/1981 | Fed. Rep. of Germany | 310/70 A |
| 2438345 | 6/1980 | France | 123/146.5 A |
| 2059175 | 4/1981 | United Kingdom | 310/191 |

*Primary Examiner*—Parshotam S. Lall

*Attorney, Agent, or Firm*—Frishauf, Holtz, Goodman & Woodward

[57] ABSTRACT

To provide a pulse for engine ignition timing, a magnetic circuit is provided which includes a permanent magnet and magnetically conducting bodies with a gap provided between one pole face of the magnet and the remainder of the magnetic structure for passage of another magnetic body in its path of revolution in which it is driven by a shaft of the engine. A Hall generator is also provided at a suitable location in the magnetic circuit for responding to a sudden reduction of the magnetic flux when the revolving body exits from the air gap. A portion of the magnetic circuit including the permanent magnet is arranged to be shifted so as to increase the air gap in response to engine intake vacuum, which weakens the effect of the magnet on the Hall generator and advances the timing. An additional magnet provides a branch magnetic circuit which likewise weakens the effect on the Hall generator, but in this case upon approaching the main magnetic circuit, which is caused to happen when the engine speed increases.

3 Claims, 1 Drawing Figure

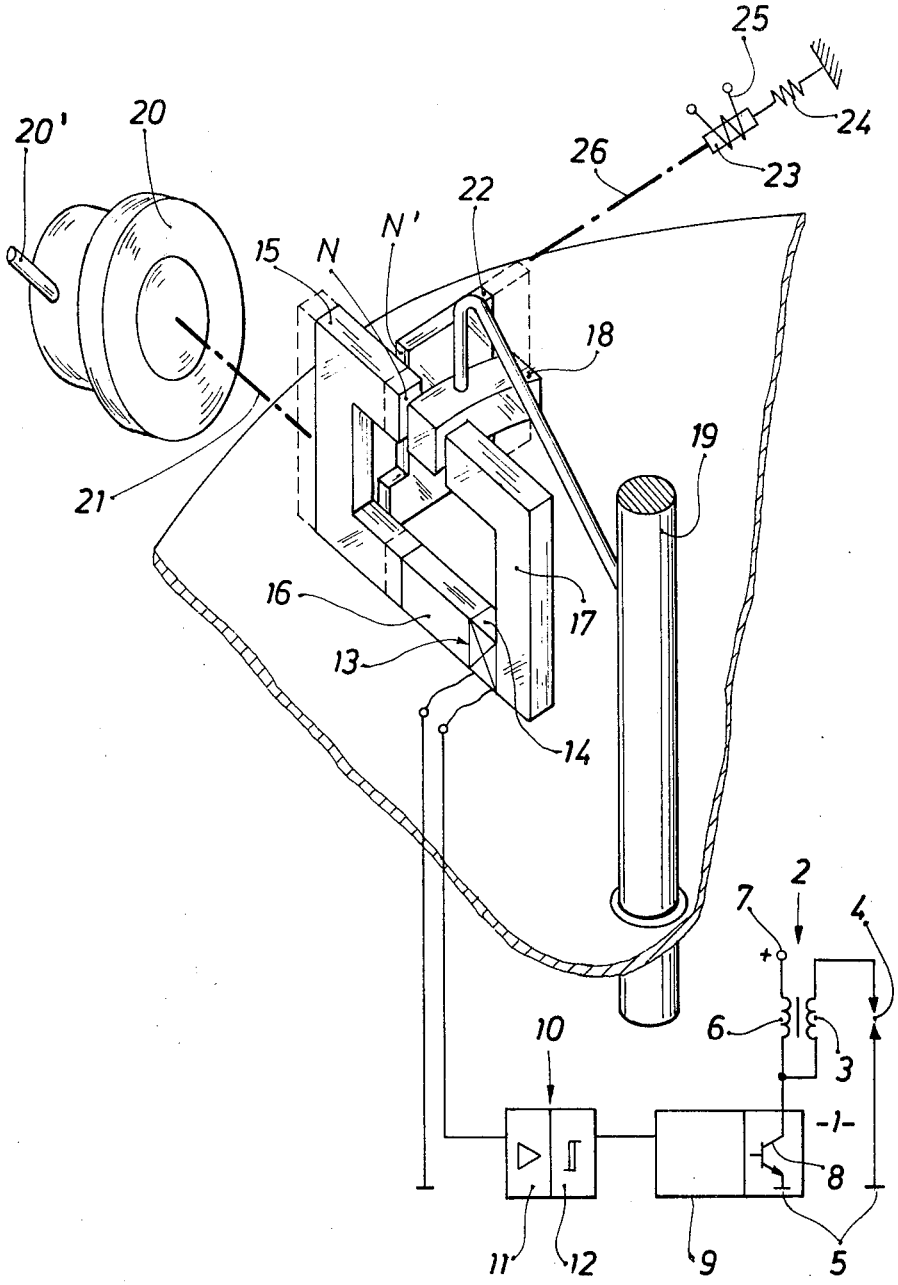
25
24
23
26
20'
20
22
N'
15
N
18
19
21
16
17
13
14
2
7
4
+
6
3
10
-1-
8
11
12
9
5

TRANSDUCER FOR IGNITION TIMING

This invention concerns engine driven pulse generators for timing ignition in engine cylinders, and particularly the kind in which an engine driven element periodically modifies the magnetic flux of a magnetic circuit which includes a magnet and also a winding which produces electric signals in response to changes in flux in the magnetic circuit.

Published German patent application DE-OS No. 28 42 386 discloses a pulse generator of the type just mentioned which, however, does not always function satisfactorily regarding the accuracy of timing engine ignition with its output pulses.

SUMMARY OF THE INVENTION

It is an object of the invention to provide a pulse generator making possible improved accuracy of ignition timing.

Briefly, in a pulse generator having a magnetic circuit containing a magnet and a pick-up coil, as well as a gap where the flux in the magnetic circuit is modified by the passage of an armature driven by the engine to be timed, at least one element of the magnetic path other than the one driven at a rate dependent upon engine speed is arranged to be movable with respect to the stationary members in response to variations in at least one operation parameter of the engine. Preferably a portion of the magnetic path including the magnet is moved in response to engine intake vacuum, and a branch magnetic path is moved in accordance with another engine parameter if it is desired for the ignition timing to be shifted in response to more than one operation parameter of the engine.

The invention has the advantage that the ignition timing can be so selected that to a close approximation the engine operates in its optimum power range.

BRIEF DESCRIPTION OF THE DRAWING

The invention is further described by way of illustrative example with reference to the annexed drawing, the single FIGURE of which is a diagrammatic perspective view of the magnetic path elements of a transducer according to the invention with symbolically indicated connections to mechanical shifting devices responsive to engine operation parameters and a simplified representation of an ignition circuit controlled by the transducer.

DESCRIPTION OF THE ILLUSTRATED EMBODIMENT

In the lower righthand portion of the drawing is a basic diagram of an ignition system 1 for an internal combustion engine that is not shown and which drives a motor vehicle likewise not shown. The ignition system includes an ignition coil 2, of which the secondary winding 3 has one end connected to at least one sparkplug 4 of which the other electrode is grounded at 5. The primary winding 6 of the ignition coil 2 during operation of the engine has one terminal connected with the positive pole 7 of a d.c. voltage source that is not shown in the drawing and the other terminal connected to the collector of a switching transistor 8, of which the emitter is grounded at 5. The negative voltage bus of the aforesaid d.c. voltage source provides the ground connections 5 and is conventionally connected to the vehicle chassis.

The transistor 8 is a component of an electronic switching apparatus 9 that is supplied with pulses through a pulse shaping stage 10 that consists of an amplifier 11 and a threshold switch 12 which respond to an input provided by the circuit element 13. The circuit element 13 provides an electrical magnitude that varies with the magnetic flux at its location and in the illustrated case is a Hall generator 14. The circuit element 13 is a component of a magnetic circuit which contains a magnet 15, preferably a permanent magnet, which exerts an effect on the element 13 through magnetically conducting bodies 16 and 17 which are part of the magnetic circuit. Between a pole face N and an end face of the magnetic body 17 there is an air gap which provides space for the passage of an element 18 that moves through the gap once in each revolution that it describes when driven by a shaft 19 that is coupled to the cam shaft or crankshaft of the engine that is not shown except for the shaft 19. The body 18 is in the illustrated case made of soft iron.

The magnet 15 is shiftable in the direction of increasing the width of the air gap from the width shown in solid lines in the drawing, and it can be moved far enough to take the position indicated in broken lines in the drawing. This shift of position takes place in dependence upon an operation parameter of the engine, in the illustrated example by the underpressure in the intake piping of the internal combustion engine. For this purpose, in the well-known way, a flexible vacuum chamber 20 is used that is connected by a small connecting tube 20' to the intake pipe of the engine and has its pressure-responsive movable diaphragm connected to the magnet 15 in a manner indicated symbolically by the dash-dot line.

Another magnet 22 is provided in addition to the magnet 15 in the same general neighborhood, in such a way that its approach to the neighborhood of the magnet 15 will weaken the effect of the magnet 15 on the switching element 13. In order to obtain this result, the neighboring pole surfaces of the respective magnet have the same polarity. Thus, if the upper pole face N of the magnet 15 is a north pole, the upper pole face N' of the magnet 22 is likewise a north pole. The displacement of the magnet 22 is so provided that with falling speed of the engine the magnet 22 shifts into the position indicated with broken lines. For this purpose, for example, an iron core 23 can be provided that, with increasing speed of the engine, is pulled inward against the force of a tension spring 24 into an electric coil 25 and is connected for shifting the magnet 22 by a drive rod symbolically indicated by a dot-dash line. The current supply for the coil 25 can for example be provided by a generator (not shown) coupled to the crankshaft.

The apparatus above described operates as follows:

As soon as the revolving element 18 passes through the gap between the pole face N and the magnetically conducting body 7, there occurs upon the exit of the body 17 from this gap a sudden reduction of the magnetic flux. This reduction is intended to have the effect of switching over the emitter-collector path of the transistor 8 into a nonconducting condition. At this moment, then, the current flowing through the primary winding 6 is interrupted, which produces a high voltage pulse in the secondary winding 3 and results in an electrical breakdown (ignition spark) in the sparkplug 4.

If now the engine must operate under partial load, then as the result of the condition of the vacuum chamber 20, the magnet 15 is shifted into its position indicated in broken lines, which produces a weakening of the magnetic flux operating on the circuit element 13. The next time that the transducer body 18 comes out of the air gap in the magnetic circuit, the resulting reduction of the magnetic flux takes place at an angular position with reference to the shaft 19 which produces an advance of the ignition timing, as is desirable in the case of operation of the engine under partial load.

If the speed of the engine increases, the magnet 22 approaches nearer to the magnet 15 and reduces the effect exerted by the magnet 15 on the circuit element 13. In consequence, upon exit of the transducer element 18 from the air gap, there is again an advance in time of the transient reduction of the magnetic flux, so that here also with increase of speed the ignition timing is advanced for the engine, which corresponds to the requirements of speed-dependent ignition timing shift.

By use of the arrangements of the invention, there is obtained in a simple way an ignition timing shift for which complicated electronic circuits would otherwise be required.

In the illustrated example, the magnets 15 and 22 were shifted. It is of course also possible to provide for shift of the magnetically conducting bodies 16 and 17 for such purposes.

The circuit element 13 can of course also be a coil or a resistance dependent upon magnetic field strength, in which case it would be appropriate to provide a voltage source in order to obtain a control signal from such a resistance.

Thus, it will be seen that although the invention has been described with reference to a particular illustrative example, variations are possible within the inventive concept.

I claim:

1. A pulse generator for engine ignition timing comprising:

a magnetic circuit having as components therein a magnet (15), and elements (16,17) of magnetically conducting material, an air gap being provided between two of said components;

means for causing a magnetically conducting body (18) to pass repeatedly through said air gap in a closed path when the engine of which the ignition is to be timed is running;

a sensor (13) responsive to changes in magnetic flux mounted on an element of said magnetic circuit for producing an electrical signal in response to a sudden change of flux, and means for shifting at least one of said components of said magnetic circuit out of its normally fixed position relative to the remainder of said components, and shifting it back so as to reduce the flux provided to said sensor by said magnet, in response to changes in an operation parameter of said engine, for advancing the ignition timing when shifting said at least one component out, and likewise for retarding the ignition timing when said at least one component of said magnetic circuit is shifted back to increase the flux provided by said magnet to said sensor.

2. A pulse generator as defined in claim 1, in which said at least one of said components of said magnetic circuit that is shiftable includes said magnet and is shiftable to vary the width of said air gap.

3. A pulse generator as defined in claim 1 or claim 2, in which an additional movable magnetic member, including a second magnet is disposed so as to provide a branch magnetic circuit that modifies the amount of flux reaching said sensor by its approach to or removal from the neighborhood of the remainder of said magnetic circuit, and means for producing said approach or removal of said additional movable magnetic member in response to a second operation parameter of said engine.

* * * * *